United States Patent [19]

Nelva-Pasqual et al.

[11] Patent Number: 4,785,482

[45] Date of Patent: Nov. 22, 1988

[54] DEVICE FOR CLEANING A TOILET SEAT

[76] Inventors: Yves Nelva-Pasqual, 22 rue Georges Clemenceau 78220, 78220 Viroflay; Denis Alain, 4 rue de l'Abbe Masure 78480, 78480 Verneuil S/Seine, both of France

[21] Appl. No.: 916,411

[22] Filed: Oct. 7, 1986

[51] Int. Cl.[4] ..... A47K 13/30

[52] U.S. Cl. ..... 4/233

[58] Field of Search ..... 4/233

[56] References Cited

U.S. PATENT DOCUMENTS

| | | | |
|---|---|---|---|
| 1,630,932 | 5/1927 | Friedrich | 4/233 |
| 3,815,158 | 6/1974 | Schnyder et al. | 4/233 X |
| 4,091,473 | 5/1978 | Matthews et al. | 4/251 X |

FOREIGN PATENT DOCUMENTS

| | | | |
|---|---|---|---|
| 22227 | 7/1917 | Denmark | 4/233 |
| 252298 | 10/1912 | Fed. Rep. of Germany | 4/233 |
| WO83/03532 | 10/1983 | France | 4/233 |

*Primary Examiner*—Charles E. Phillips

*Attorney, Agent, or Firm*—Browdy and Neimark

[57] ABSTRACT

A device for cleaning the toilet seat of a toilet bowl, in which the toilet seat 22 is brought into vertical position in a tank 14 by a translational movement of transport means driven by vertical endless screws. A trap door 18 is thus controlled by a horizontal shaft and link rods 60*a*, 60*b* which opened during the entry and exit movements of the seat. A cleaning arm 66 is connected to a cleaning water intake, and means are provided to cause hot drying air to circulate in the tank. A control unit containing a cleaning water tank, a hot-air generator, and a time-delay control unit can be triggered to perform a complete cleaning cycle, and can be located as desired. The device is for toilets in private or public use.

7 Claims, 6 Drawing Sheets

DEVICE FOR CLEANING A TOILET SEAT

BACKGROUND OF THE INVENTION

This invention relates generally to devices for cleaning toilet bowl seats.

In the field, a certain number of patents are already known that teach devices intended for the more or less automatic cleaning of toilet bowl seats (otherwise known as "toilet seats").

Patents FR-A No. 2 316 905 and FR-A No. 2 525 254 both teach of devices intended for sequential and entirely automatic cleaning of toilet seats. More specifically, several seats are routed by drive means along a complex path in a large-sized closet in which brush cleaning and water spraying means as well as drying means are provided. Thus, one or more seats are cleaned while another seat rests on the bowl for its normal use.

The devices taught in these patents are highly complex and highly costly, particularly by the large number of mechanical moving parts that they bring into play. The fact of using several seats further increases this complexity and this cost. Moreover, the great complexity of the devices of these patents is further linked to the fact that an effort has been made to drive the various mechanical elements using the buoyancy on a body submerged in the toilet tank. This technical solution, however, appears unreasonable in the case in point.

By patent FR-A Nos. 2 298 651 and 2 103 023, devices are known which are made to cover the toilet bowl seat after it is used. Thus, a lid equipped with liquid cleaning means is brought over the seat in horizontal position. Sealing means are provided to assure a fluid-tightness with the outside lateral edges of the seat.

However, these devices are disadvantageous in that they require one or more manual interventions of the user (among others, operating the lid), and in that the risks of leaking are nevertheless high.

SUMMARY OF THE INVENTION

The invention aims at mitigating these drawbacks of the prior art and at proposing a toilet bowl seat cleaning device that has a completely simple and reliable operation, and this with reduced bulk.

Another object of the invention aims at proposing a device in which all the operations are performed automatically, without intervention of the user.

For this purpose, this invention relates to a cleaning device for the seat of a toilet bowl, characterized in that it comprises, in combination:

a chamber extending vertically in the back region of the bowl, and whose front face is at least partially defined by a trap door, transport means to bring the seat from a use position, in which it extends horizontally over the bowl, to a cleaning position, in which it extends vertically in the chamber, and to control simultaneously the opening and closing of the trap door, said transport means comprising a motorized unit having bidirectional vertical movement and being linked by connecting elements to a back region of the seat and to the trap door, cleaning means provided in the chamber and made to spray cleaning water on the seat, drying means made to cause air to circulate in the chamber, and time-delay means for control of the motorized unit, the cleaning means and the drying means.

BRIEF DESCRIPTION OF THE DRAWINGS

The invention will be better understood on reading the following description of a preferred embodiment of it, given by way of example and made with reference to the accompanying drawings, in which:

With reference to the drawings, and first of all to FIGS. 1A, 1B, and 1C, a toilet bowl seat cleaning device of this invention is mounted in the back region of a standard bowl 10. It comprises a chamber or parallelepipedal housing, for example of sheet metal, made of a recessed bottom box 12, a tank 14 with vertical walls and a cover 16. In the front face of tank 14 is formed an approximately rectangular trap door 18 which is mounted to rotate at its upper end around a horizontal axis 20. Thus, trap door 18 is able to be opened at its low end to make it possible, by combined means described above, to bring into the tank, for cleaning purposes, a seat or "toilet seat" 22 such as conventionally provided on bowl 10. More specifically, FIG. 1A illustrates the normal state of the device, seat 22 resting on bowl 10 and the chamber being closed. FIG. 1B illustrates an intermediate stage of the transfer of seat 22 in the chamber for cleaning purposes, trap door 18 being open for this purpose. Finally, FIG. 1C illustrates the state in which trap door 18 is closed in a fluidtight manner, the cleaning of the seat inside the chamber thus being able to take place.

Figure 1C:
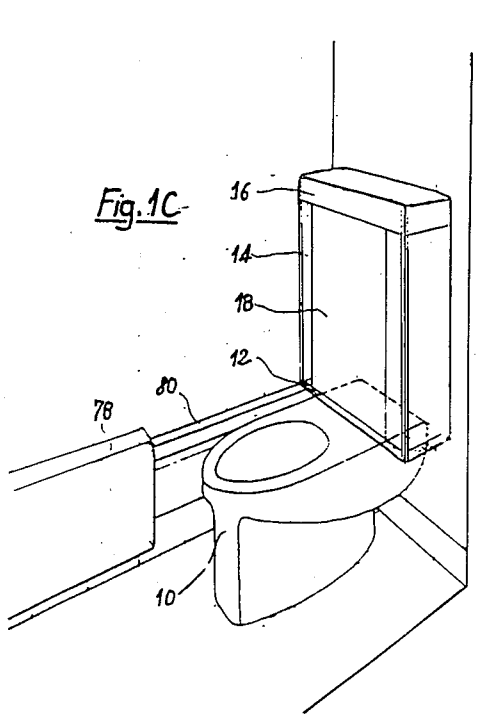
FIGS. 1A, 1B and 1C are diagrammatic views in perspective illustrating various states of the device of the invention.

It will be noted here that, when the toilet bowl is of the type to be rinsed by water flushing, this flushing can be placed behind the chamber, which is advantageously shallow.

With reference now to all the figures, the chamber protects a horizontal upper plate 24 whose dimensions are approximately suited to those of the horizontal section of the chamber. Plate 24 is supported in the chamber by an angle iron 26 fastened, for example welded, to the inside face of the back wall of tank 14, and by the upper edges of two re-entrant flanges 28 provided on the periphery of the opening of the tank in which trap door 18 is provided. On the upper surface of plate 24 is fastened an electric motor 30 having two directions of rotation, for purposes explained below. In the lateral regions of plate 24, symmetrically, are mounted to rotate in bearings two serrated pulleys **32*a*, 32*b* whose rotation is synchronized by a coupling chain 34. Transmission means (not shown), such as toothed wheels or the like, are provided between motor 30 and serrated pulley 32*a***. The two pulleys can thus be selectively driven in rotation in one direction or in the other, and this in synchronism, for purposes explained below.

The shaft with which each serrated pulley **32*a*, 32*b* is solid extends vertically downward as a threaded rod or lead screw, respectively 36*a* and 36*b*. The lower ends of the two lead screws are received for rotation in suitable bearings (not shown). These bearings are made in a lower crosspiece 38 which exhibits the shape of a horizontal rectangular plate and which is connected to upper plate 24 by two vertical uprights 40***a*, 40*b* which extend parallel to the lead screws on the inside in relation to them. The fastening of the unit in tank 14 is assured by two vertical assembly rods 41*a*, 41*b* (FIG. 3A) associated with nuts 9 (not shown). The uprights show the shape of "U-shaped" cross section profiles open to the outside, for guide purposes as explained below. It can be noted here that, when the above-described unit is put in place in the tank, a central compartment is defined in which the cleaning and drying of the seat takes place, and two lateral compartments which protect most of the mechanical moving parts.

Figure 4:
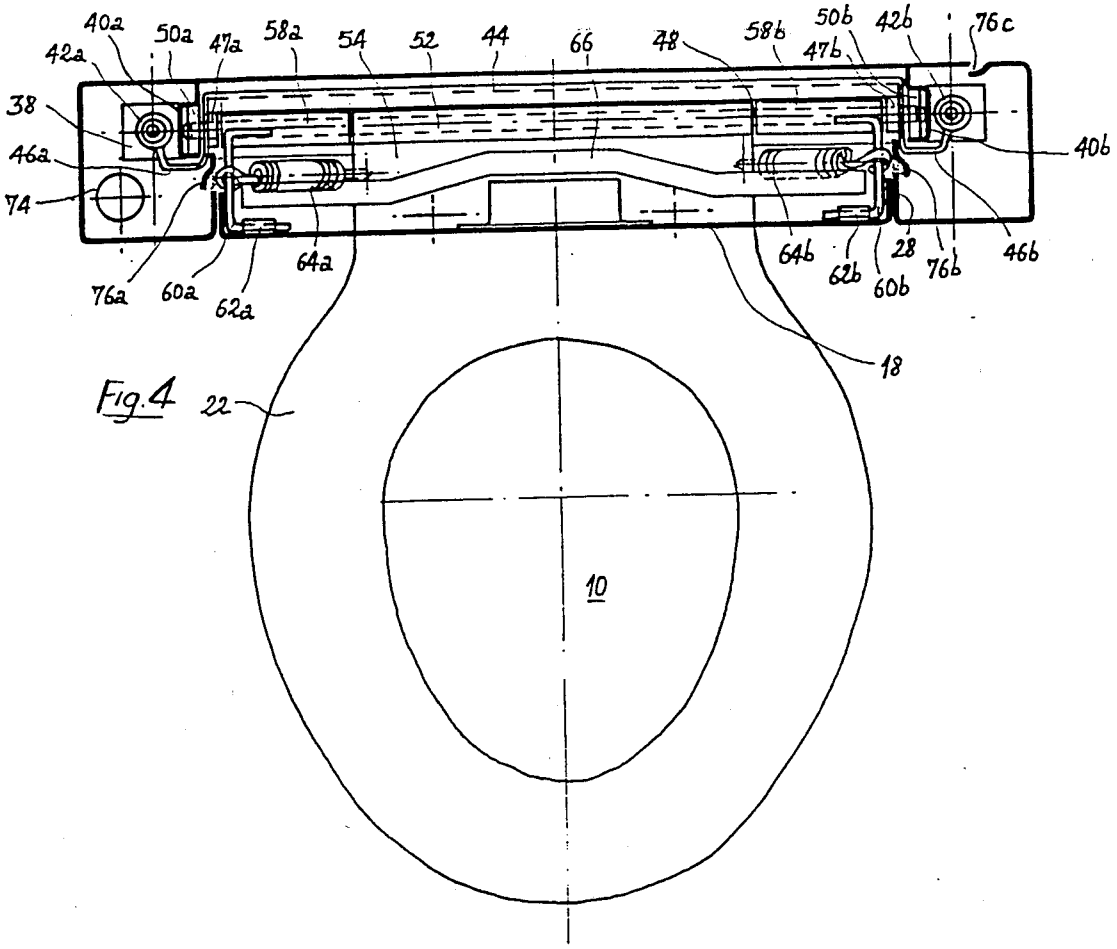
FIG. 4 is a top view in section of the device.

On each of lead screws 36*a*, 36*b* is mounted a tapped sleeve, respectively 42*a* and 42*b*. A mobile crosspiece 44 extends horizontally between the two tapped sleeves. This crosspiece is connected to the sleeves by suitable rigid connections 46*a*, 46*b* which pass around uprights 40*a*, 40*b* respectively. As FIG. 4 shows in particular, a horizontal shaft 48 is mounted to rotate in smooth bearings 47*a*, 47*b* of the two connections 46*a*, 46*b* and extends parallel to mobile crosspiece 44. At the free ends of shaft 48, between connections 46*a*, 46*b* and vertical uprights 40*a*, 40*b*, rollers 50*a* and 50*b*, respectively, are mounted to rotate. These rollers are received inside the grooves defined by said uprights, thus to assure the guiding of the vertically mobile unit consisting of tapped sleeves 42*a*, 42*b*, connections 46*a*, 46*b*, crosspiece 44 and shaft 48.

Figure 2:
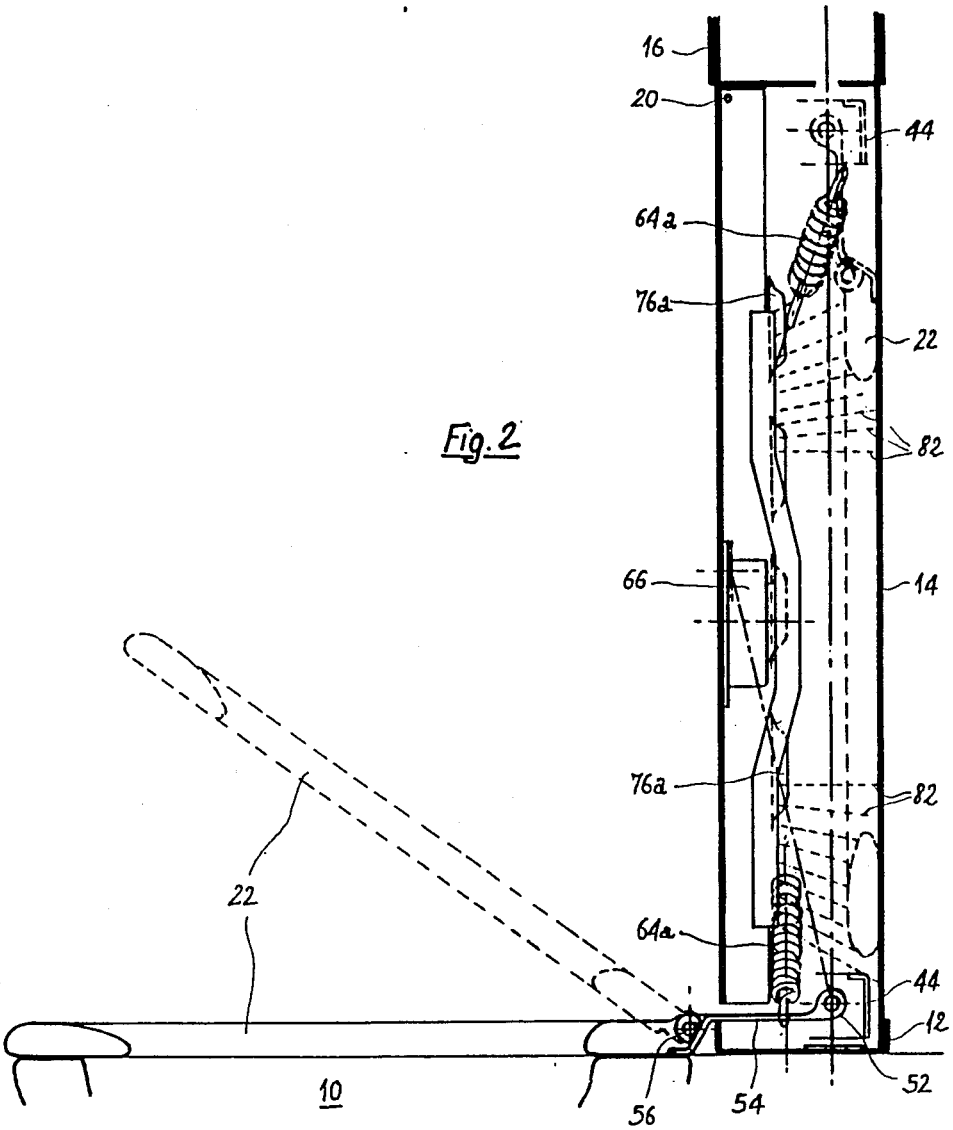
FIG. 2 is a side view in section of the device of the invention.

On shaft 48 is mounted to rotate a first smooth sleeve 52 which is solid with a support element 54 of seat 22 of the bowl. At the front end (on the left in FIG. 2) of element 54 is provided a shaft 56 intended to make it possible to rotate seat 22, in the manner of a standard seat. Shaft 48 also receives in rotating two smooth sleeves 58*a* and 58*b* which are respectively solid with the first ends of two link rods 60*a*, 60*b*. The other ends of link rods 60*a*, 60*b* are mounted to rotate on the inside face of trap door 18, in the region of the middle of the latter in vertical direction, by suitable bearings 62*a*, 62*b* (see FIG. 4).

In addition, there are two helical draw springs 64*a*, 64*b* which are mounted between support element 54 of seat 22 and the middle of link rods 60*a*, 60*b*. Torsion springs mounted between smooth sleeves 54 and 58*a*, 58*b*, respectively, can also be used.

End-of-travel contactors, respectively indicated by 65 and 67, are mounted on upper plate 24, for a purpose which will be described below.

The device as described until now further possesses cleaning means which comprise a cleaning arm 66 mounted to rotate approximately in the center of the inside face of trap door 18. The cleaning arm is of the type whose rotation is triggered by water pressure, and is fed by a cleaning water intake pipe 68 which extends from a notch 70 made for its passage through the back wall of tank 14, below plate 24 passing around the elements that carry it, and obliquely toward the axis of cleaning arm 66. Pipe 68 is flexible, at least in the rotating region of trap door 18, so as not to hamper its movements. Bottom box 12 of the chamber of the device is made to recover the used water and evacuate it through an opening 72 connected to a suitable evacuation pipe (not shown).

Figure 3D:
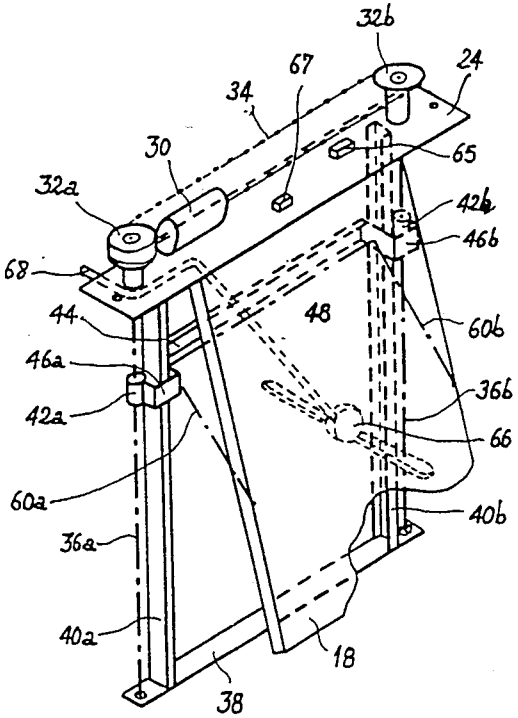
FIGS. 3A, 3B, 3C and 3D are partial detail views in perspective of the device.
Figure 3A:
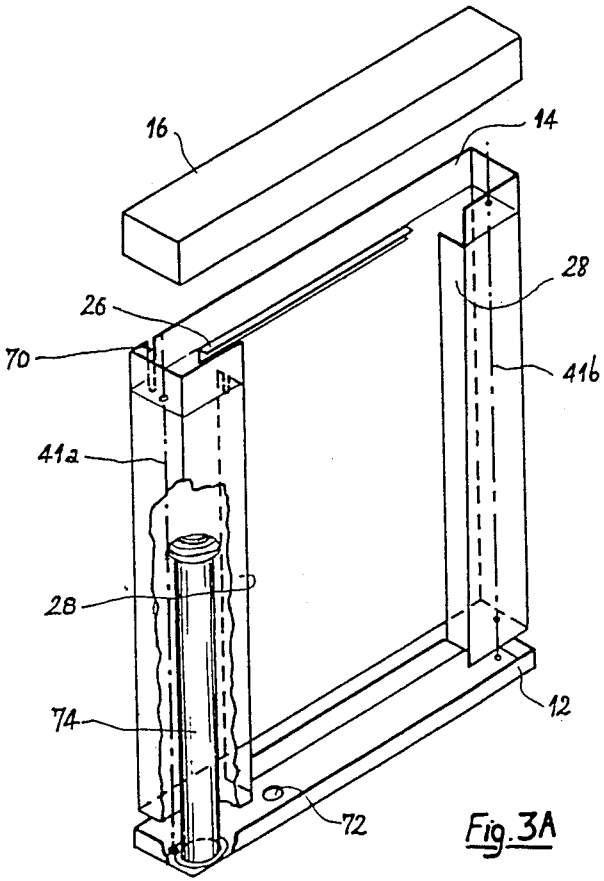
Figure 3C:
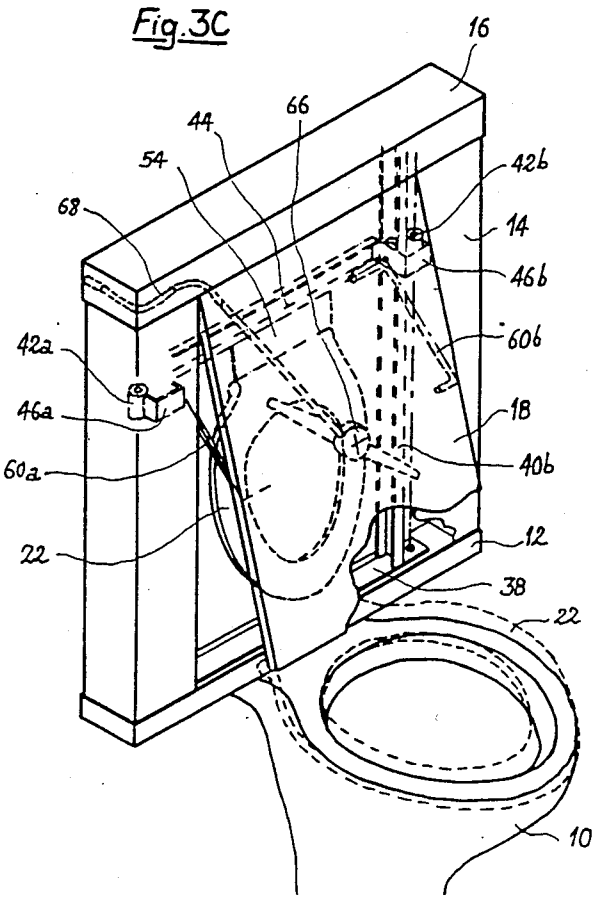
Figure 3B:
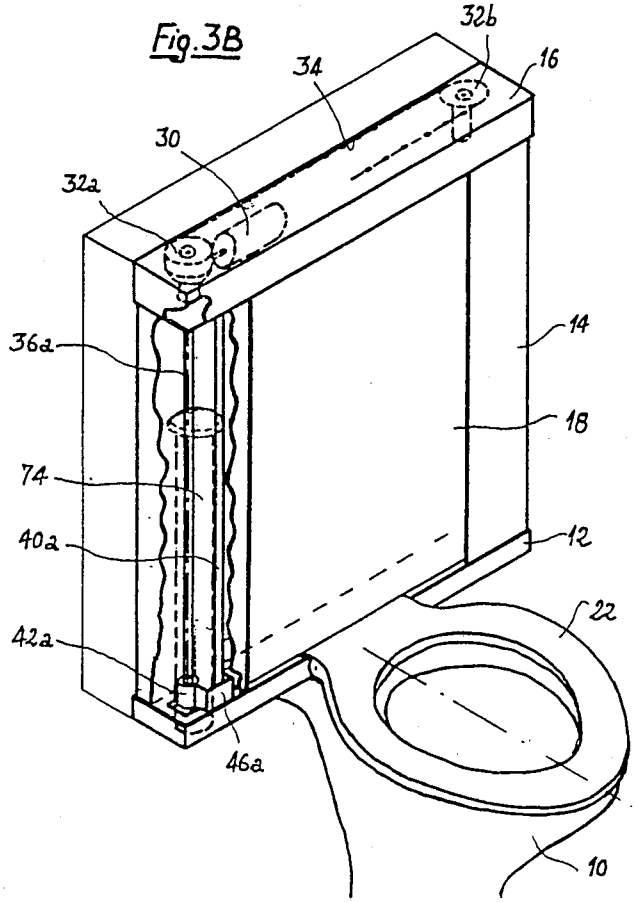

In addition, there are drying means which comprise, in this embodiment, a hot-air intake pipe, indicated by 74 in FIGS. 3A, 3B and 4, which makes it possible to introduce hot air for drying in the associated lateral compartment (see above). The hot air is introduced into the central compartment through a multiplicity of holes in the shape of vertical slots 76*a* (FIGS. 2 and 4) made in corresponding flange 28 of tank 14. The drying air is taken up through similar holes 76*b* made in the opposite flange of the tank, thus to enter into the second lateral compartment, hence it is evacuated through a multiplicity of holes 76*c* made in the back face of this latter.

Figure 1B:
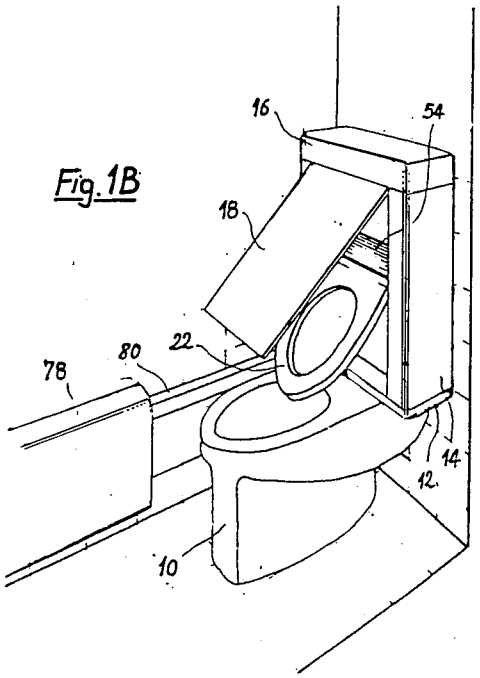
Figure 1A:
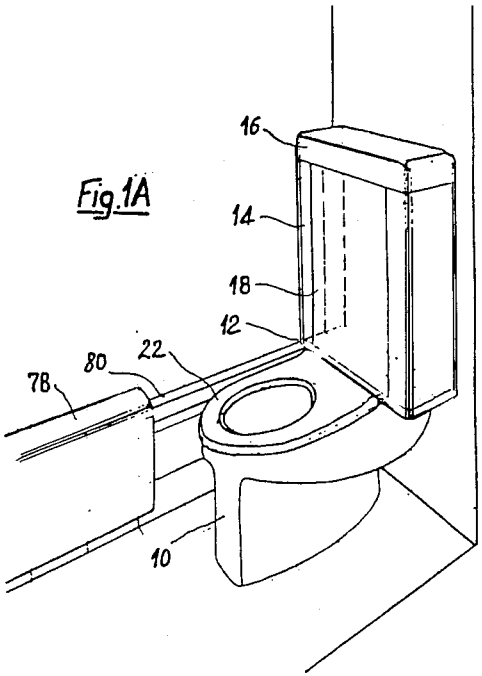

Finally, the device comprises a control unit, indicated by 78 in FIGS. 1A to 1C. This unit 78 can be for protecting the following elements (not shown in the drawings) to which the present invention as illustrated herein is not limited: a cleaning water tank equipped with a heating resistor; a tank of cleaning and/or disinfecting agent; an electric cleaning pump; if necessary, in case the cleaning solution is recycled, an evacuation pump; solenoid valves for water intake and for cleaning agent metering; a thermostat, liquid level contacts and other auxiliary elements of automation. In addition, there are electric air heating and blowing means and a time delay electric control unit intended to control the cleaning water pump, the air heating and blowing means, and electric motor 30 described above. In this regard, sheath 80 is provided to connect between control unit 78 and the device mounted on the bowl. In this example, this sheath protects an intake piping for the cleaning water, connected to pipe 68, a hot-air intake pipe, connected to pipe 74, and the electric wires connected to motor 30, to end-of-travel contactors 65, 67 and to the force limiter. According to the configuration, sheath 80 can also protect a cold water intake pipe from the tank, and a cleaning water return pipe for recycling purposes. A predetermined operating cycle can be accomplished, by providing a time-delay function in the control unit. This cycle can be triggered by any manual or automatic means.

Several preferred solutions, however, can be envisaged for this purpose. An initial part of the cycle (as described below) can be triggered by simple pressure on a control button provided on control unit 78. Alternatively, the beginning of the cycle can be triggered as a result of the introduction by the user of a coin in a standard coin box, such a solution being particularly suitable for public places. Such a coin box, of course, can be installed in any suitable position of the toilet.

The cycle can continue, as will be seen below, by being synchronized with the manual triggering of the flushing of the associated plumbing installation. An electric contactor will be provided in this case in the flushing installation to detect this maneuver. Another solution will involves triggering the continuation of the operating cycle automatically by the departure of the user, by using for example a photoelectric cell, an electric contact combined with the bolt of the door of the room, etc.

Figure 5:
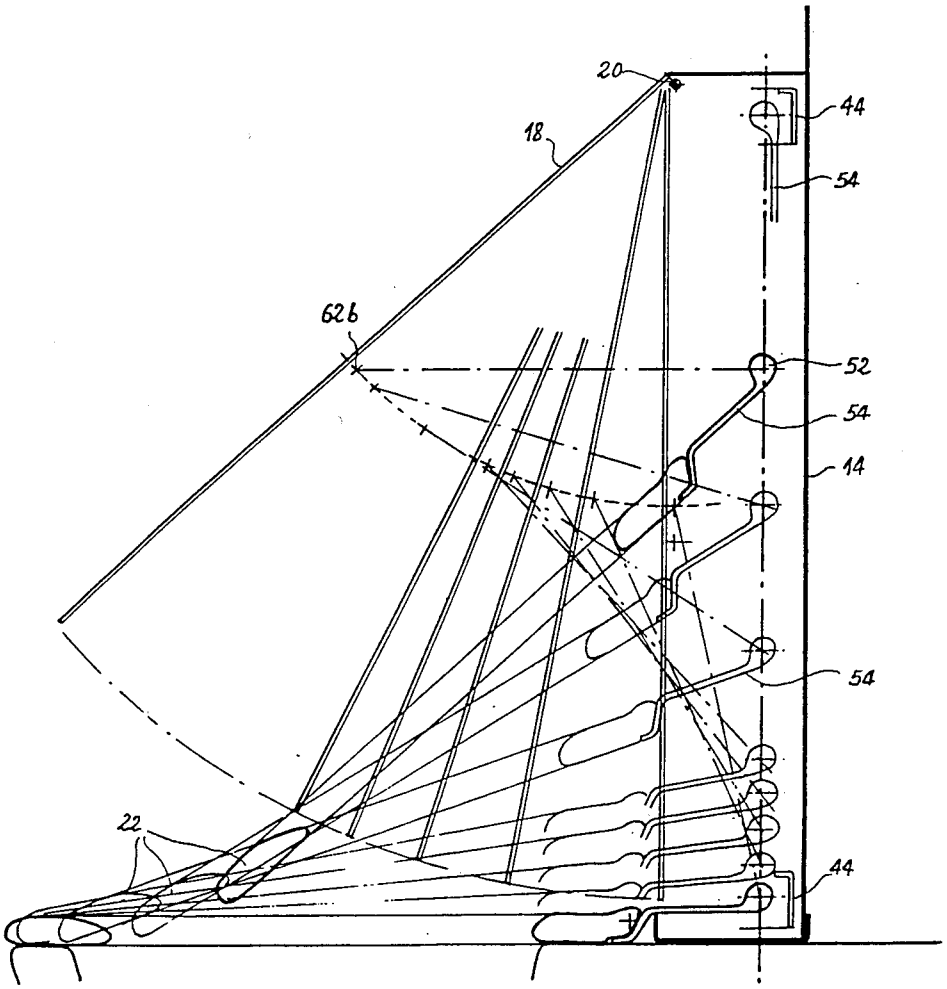
FIG. 5 is a side view illustrating the movement of certain elements of the device.

The operation of the cleaning device itself is as follows. First of all, in the rest position of the device, seat 22 is clean and dry, but inside the tank. When a user desires seat 22 to be brought over toilet bowl 10, he triggers the beginning of the cycle, for example by depressing a button of the control unit or by introducing a coin into a coin box, as mentioned above. Consequently, the time-delay control unit first of all causes the rotation of electric motor 30, to drive in rotation the two lead screws 36*a*, 36*b* in such a direction that tapped sleeves 42*a*, 42*b* descend progressively along them from a high position, in which seat 22 hangs vertically in the central compartment of the tank and trap door 18 is closed against tank 14. This descending movement imparted to the tapped sleeves, causes the joint descent of mobile crosspiece 44 and its shaft 48. This movement has the effect of gradually opening trap door 18 by two link rods 60*a*, 60*b*, according to the geometric representation of FIG. 5. Simultaneously, seat 22 is gradually brought downward on bowl 10 from the central compartment, by its support 54. FIG. 5 clearly shows that the dimensions and arrangements of the various elements have been calculated so that the respective travel of each of the trap door 18 and seat 22 are geometrically compatible. It can be noted here that springs 64*a*, 64*b* exert during this movement a pulling force upward on support element 54 of the seat. The torque thus produced makes it possible to prevent the free end of seat 22 (at the left in FIG. 5) from "butting" against bowl 10 during its descent.

At the end of the descent movement, trap door 18 closes, which is detected by contactor 67, thus to interrupt the rotation of motor 30. Seat 22 is then resting on bowl 10.

The user can then use the toilet bowl in a standard way. After use, the means for triggering the continuation of the cycle, as described above (by flushing or by the departure of the user), cause the execution of the reverse movements of those described above, thus to bring seat 22 into vertical position in the central compartment of the tank. End-of-travel contactors 65 and 67 then detect respectively the high end position of mobile crosspiece 44 (and therefore its shaft 48) and the correct closing of trap door 18 (for safety purposes), thus to interrupt the lifting movement and to inform the control unit that the cleaning can then take place. The electric pump associated with the cleaning water tank is then started by said unit to feed cleaning arm 66. This latter then enters in rotation while spraying cleaning water through a multiplicity of suitable holes, as indicated by 82 in FIG. 2, against the upper face of the seat (left face in the same figure). The used water dripping from the seat and from the inside walls of tank 14 is collected in bottom box 12 and can be evacuated, for example, in the emptying of the bowl itself, or further recycled until the end of the cleaning operation. The cleaning is performed for a predetermined time under the control of the control unit, then interrupted to leave the place for drying.

For this purpose, the hot-air blowing and heating means contained in control unit 78 are started, also for a predetermined time and along the path as described above, thus to dry seat 22.

At the end of the drying, the operation of the device is stopped, until once again the cycle begins as mentioned above (re-entered seat, clean and dry), when the toilet bowl is ready for fresh use.

Of course, this invention is in no way limited to the embodiment described, but includes any variant or modification that a man of the art can bring to it. In particular, any suitable fluidtightness will be provided in the device, particularly between trap door 18 and the adjacent edges of tank 14, an between trap door 18 and bottom box 12.

Also, for safety purposes, electric motor 30 can be equipped with any force limiting device, for example of the type having an elastic mounting of the motor on its base, in association with an electric contact, which will be opened in case of excessive reaction. This limiter will provide a mechanical protection for the device, and the protection from malicious users who would attempt to hamper in any way the various movements of the mobile parts.

In addition, the device can be designed so that all the electric detections and the controls are performed under low voltage, for safety purposes when regulations require it.

Finally, the operating cycle of the device is not limited to the preceding description. Particularly, it can be performed in a single time from a position in which the seat rests on the bowl and must be cleaned.

Moreover, it is found that the device according to the embodiment described is easily removable, for purposes of maintenance or the like. Actually, the entire mechanical unit contained in the chamber, including trap door 18 and seat 22, is connected to it only by assembly rods 41*a*, 41*b* described above, and removal of them, after the disconnection of the pipes and electric wires coming from the control unit, makes it possible to remove said mechanical unit in one piece upwards.

We claim:

1. In a cleaning device for the seat of a toilet bowl comprising a chamber extending vertically in a back region of the toilet bowl, said chamber having a trap door with an inside face, transport means for bringing the seat from a use position, in which it extends horizontally over the bowl, to a cleaning position, in which it extends vertically within said chamber, and for controlling simultaneously opening and closing of said trap door, cleaning means provided in said chamber for spraying cleaning water on the seat when the seat is in said cleaning position, and drying means for circulating air in said chamber to dry the seat while in said cleaning position, the improvements comprising:

said device including only one single toilet seat, said seat having a rear end on a side adjacent said chamber when in said use position;

said transport means of said seat in said chamber extending above and behind said seat, and including a motorized unit having bidirectional vertical movement, a horizontal shaft and two link rods, said single seat being connected at said rear end thereof to said motorized unit, each said link rod having a first end mounted on said trap door to rotate in correspondence with said bidirectional vertical movement of said motorized unit to open and close said trap door;

said transport means further comprising two vertical lead screws and an electric motor;

said horizontal shaft having two ends, each said end of said horizontal shaft having a respective tapped sleeve which circulates on a respective one of said said two vertical lead screws, said two vertical lead screws being rotated in synchronism by said electric motor to provide said bidirectional vertical movement to said horizontal shaft;

said motorized unit being mounted to rotate around said horizontal shaft during said bidirectional vertical movement; and said cleaning means including a rotating cleaning arm mounted on said inside face of said trap door.

2. The device of claim 1, comprising said motorized unit including a support element, the connection of said seat to said motorized unit being by said seat being connected to said support element, and at least one draw spring connecting between said support element and at least one of said link rods.

3. The device of claim 1, comprising a frame suspended inside said chamber so as to be easily removed from said chamber, and said motorized unit being mounted to be vertically mobile on said frame for providing said bidirectional vertical movement, and to be removed with said frame from said chamber for purposes of maintenance.

4. The device of claim 1, comprising said transport means including control means for controlling the closing of the trap door with said link rods, and force limiting means in said motorized unit for avoiding excessive force in connection with motion of moving parts of the device.

5. The device of claim 1, comprising time-delay control means for controlling the operation of said transport unit, said cleaning means including a water pump and drying means, and connection means for connecting between said unit control and said chamber, said connection means including piping and electric wires.

6. The device of claim 5, comprising triggering means for triggering an initial sequence of operation of said time-delay control means, said triggering means including a coin box into which a user inserts a coin for causing said triggering of said initial sequence, wherein the cleaned and dried toilet seat is brought into said use position by said initial sequence of operation.

7. The device of claim 6, comprising further means for triggering a final sequence of operation of said time-delay control means by the flushing of said toilet bowl by said user, wherein said toilet seat is returned to said cleaning position and cleaned and dried by said final sequence of operation, after said toiled bowl is flushed.

* * * * *